US008327544B2

(12) United States Patent
De Klerk et al.

(10) Patent No.: US 8,327,544 B2
(45) Date of Patent: Dec. 11, 2012

(54) RAZOR

(75) Inventors: John Christopher De Klerk, Cape Town (ZA); Brian Arthur Steinhobel, Johannesburg (ZA)

(73) Assignee: Valeo Trade and Invest 3 (Pty) Ltd., Bishopscourt (ZA)

( * ) Notice: Subject to any disclaimer, the term of this patent is extended or adjusted under 35 U.S.C. 154(b) by 415 days.

(21) Appl. No.: 12/597,108

(22) PCT Filed: Sep. 4, 2007

(86) PCT No.: PCT/ZA2007/000057

§ 371 (c)(1), (2), (4) Date: Oct. 22, 2009

(87) PCT Pub. No.: WO2008/134777

PCT Pub. Date: Nov. 6, 2008

(65) Prior Publication Data

US 2010/0095530 A1 Apr. 22, 2010

(30) Foreign Application Priority Data

Apr. 26, 2007 (ZA) ..... 2007/03439

(51) Int. Cl.
*B26B 21/44* (2006.01)

(52) U.S. Cl. ..... 30/41; 30/41.5

(58) Field of Classification Search ..... 30/41, 41.5, 30/123, 535, 538

See application file for complete search history.

(56) References Cited

U.S. PATENT DOCUMENTS

| | | | | |
|---|---|---|---|---|
| 4,562,643 | A * | 1/1986 | Cataudella | 30/41 |
| 4,653,188 | A * | 3/1987 | Kwak | 30/41 |
| 4,753,006 | A * | 6/1988 | Howe | 30/41 |
| 5,241,751 | A | 9/1993 | Goh | |
| 5,337,478 | A | 8/1994 | Cohen et al. | |
| 5,564,190 | A * | 10/1996 | Fleetwood | 30/41 |
| 5,655,302 | A * | 8/1997 | Mroczka | 30/41 |
| 5,664,330 | A * | 9/1997 | DeMars | 30/41 |
| 6,312,436 | B1 | 11/2001 | Rijken et al. | |
| 6,665,937 | B2 * | 12/2003 | Furst et al. | 30/41 |
| 7,178,241 | B1 * | 2/2007 | Cummings et al. | 30/41 |
| 7,788,810 | B2 * | 9/2010 | Noble | 30/41.5 |
| 2005/0126008 | A1 | 6/2005 | Pennella et al. | |
| 2005/0132574 | A1 * | 6/2005 | Tomassetti | 30/41 |
| 2007/0084058 | A1 | 4/2007 | Szczepanowski et al. | |
| 2007/0221681 | A1 | 9/2007 | Eisinga et al. | |
| 2008/0189953 | A1 * | 8/2008 | Jessemey et al. | 30/45 |
| 2009/0007433 | A1 * | 1/2009 | Hawes et al. | 30/45 |
| 2010/0115774 | A1 * | 5/2010 | De Klerk | 30/41.5 |

FOREIGN PATENT DOCUMENTS

| | | | |
|---|---|---|---|
| DE | 4 335 449 | * | 4/1994 |
| WO | 2005/099977 | | 10/2005 |
| WO | 2007/042985 | | 4/2007 |

OTHER PUBLICATIONS

International Search Report issued Dec. 19, 2007 in International (PCT) Application No. PCT/ZA2007/000057.

Patent Cooperation Treaty (PCT) International Preliminary Report on Patentability issued Jun. 26, 2009 in corresponding International Application No. PCT/ZA2007/000057.

* cited by examiner

*Primary Examiner* — Hwei C Payer

(74) *Attorney, Agent, or Firm* — Wenderoth, Lind & Ponack, LLP

(57) ABSTRACT

A razor which includes at least one razor blade, a container for a shaving composition and an electrically powered actuating mechanism, for causing shaving composition from the container to be discharged from the shaving head.

7 Claims, 7 Drawing Sheets

RAZOR

BACKGROUND OF THE INVENTION

1. Technical Field

This invention relates to a razor of the kind which includes one or more razor blades which are movable with a shaving action, by a user, over a region which is to be shaved.

A razor of the aforementioned kind is normally used in conjunction with a soap or lather, a gel or cream (collectively referred to herein as "a shaving composition") which facilitates the shaving process.

2. Description of the Related Art

It has been proposed to combine a canister, which contains a shaving composition, with a shaving head which carries a razor blade. The canister is internally pressurized so that shaving composition can be discharged directly onto a shaving zone, during use of the razor. In a different approach, a flexible tube is squeezed, manually or through the use of a suitable device, to expel a shaving composition directly onto a zone which is being shaved (see for example U.S. Pat. No. 7,178,241, U.S. Pat. No. 5,664,330, U.S. Pat. No. 5,655,302, U.S. Pat. No. 5,564,190, U.S. Pat. No. 4,753,006, U.S. Pat. No. 4,653,188, U.S. Pat. No. 4,562,643, US 2007/017097, US 2005/132574 and DE 4335449.

With dispensing razors of the kind referred to it can be difficult for a user to match the rate at which the shaving composition is delivered to the shaving zone with the user's actual requirement. Thus, the dispensing arrangement might deliver too much or too little of the shaving composition A need exists for a razor which is of compact construction, which can make use of modern technology which is based on the user of multiple razor blades, and which can deliver a shaving composition at an accurate rate which can be varied to meet a user's individual requirements.

SUMMARY OF THE INVENTION

The invention provides a razor which includes a body, a shaving head, at least one formation on the shaving head for engagement with at least one razor blade, a container for a shaving composition, an electrically powered actuating mechanism for causing shaving composition from the container to be discharged from the shaving head, and a controller for controlling the operation of the actuating mechanism.

The controller may include a switch which is used to cause operation of the actuating mechanism. The switch may be actuable manually by a user or automatically in response to a shaving or other action.

The switch may be a multi-position switch which, in each position, causes the actuating mechanism to function at a different respective rate thereby to vary the discharge rate of the shaving composition.

Alternatively the switch may be continuously variable between two limiting positions which correspond respectively to zero and maximum discharge rates.

The switch may be a manually movable device e.g. a lever or rotating switch or any equivalent device or, preferably, an electronic switch which for example is similar to an electronic controller on a radio. This type of switch (e.g. a capacitive sensor or proximity switch) when pressed continuously or rotated in one direction, gradually (for example) increases the volume which is output by the radio in a smooth and continuous way. Effectively this is done by increasing the energy level supplied to an amplifier. A similar technique can be adopted to increase the energy level applied to the actuating mechanism so as to control the rate of discharge of the shaving composition.

Another possibility is to have a user controlled input to the actuating mechanism. Each time a signal is applied to the input, e.g. by pressing a push-button switch, the actuating mechanism is powered for a short period of time, the duration of which can be varied by means of another control device.

In a variation of the invention the razor includes a sensor of any appropriate kind which is responsive to a shaving action and the controller is responsive to the sensor.

The shaving head may be movable to a limited extent relative to the body in response to a shaving action, and the sensor may be responsive to the shaving head movement. With this embodiment of the invention the sensor may for example comprise a switch which may be spring loaded.

The switch may be actuated by a small degree of movement of the shaving head. This movement arises when a shaving action takes place during which the shaving head is brought into contact with a region which is to be shaved. However, any suitable mechanism, which is responsive to a shaving action, can be employed as a sensor.

"Shaving action" is used herein to denote an action which is carried out during a shaving process. Without being limiting a shaving action typically includes movement across a region which is to be shaved or a force, even a slight force, which is applied to a region during a shaving action. Depending on the shaving action, which is being monitored by the sensor, it is possible for the sensor to be responsive to movement or force.

The actuating mechanism may be of any suitable kind and, in one embodiment, is an electrical motor which is energized in a controlled manner by the controller.

The container may include a plunger which is movable by the electrical motor to pressurize the shaving composition, and thereby expel the shaving composition at a controlled rate from the container.

The container may include a threaded shaft and the plunger may be threadedly engaged with the shaft which is rotatable by the electrical motor thereby to move the plunger along the shaft within the container.

The electrical motor is preferably an electrical stepper motor.

The controller may make use of a microprocessor which, using control techniques known in the art, causes the stepper motor to be energized in a controlled manner so that the discharge of the shaving composition from the shaving head takes place at a controlled rate.

The shaving head may be detachably engaged with the body.

The at least one formation on the shaving head is preferably engageable with a plurality of razor blades which are arranged closely spaced and parallel to one another. With this arrangement the shaving composition is preferably discharged, at least, between two adjacent razor blades and ahead of a leading blade so that it goes directly to a region or zone which is being shaved.

The container may be detachably engaged with the body.

In one embodiment the razor includes a body in which is formed a compartment, a battery, a controller and an electric motor inside the compartment, a container for a shaving composition, an elongate threaded shaft, which is rotatable by the motor, and a plunger, inside the container. The plunger is threadedly engaged with the shaft and is constrained against rotation within the container. The razor further includes a shaving head having at least one formation which is engageable with at least one razor blade, and a sensor which, in response to an input action, transmits a signal to the controller which thereby causes the battery to energize the motor, in a controlled way, to rotate the shaft and cause the plunger to advance inside the container and expel shaving composition from the container to at least one discharge location at the shaving head.

The input action may be a switch action or a shaving action.

In another embodiment the razor includes a body in which is formed a compartment, a shaving head on the body which has at least one formation which is engageable with at least one razor blade, a battery and an electric motor inside the compartment, a container for a shaving composition, a plunger which is inside the container and which is movable by a motor thereby to expel shaving composition from the container to at least one discharge location at the shaving head. The razor further includes a controller and a user actuable input device connected to the controller which, in response to an input from the device, controls the connection of the battery to the motor thereby to vary the movement of the plunger and so control discharge of the shaving composition at the at least one discharge location.

BRIEF DESCRIPTION OF THE DRAWINGS

The invention is further described by way of examples with reference to the accompanying drawings in which.

DESCRIPTION OF PREFERRED EMBODIMENTS

Figure 1:
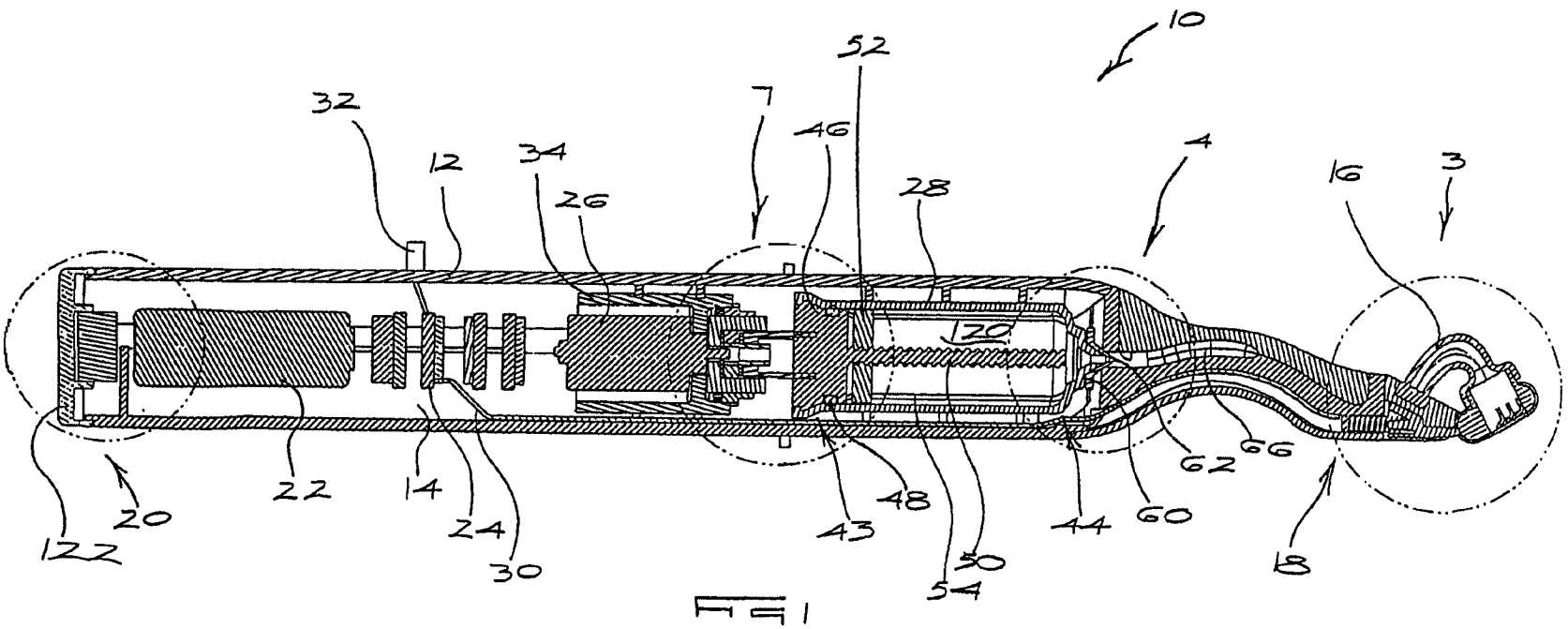
FIG. 1 is a side view, partly sectioned, of a razor according to the invention.
Figure 2:
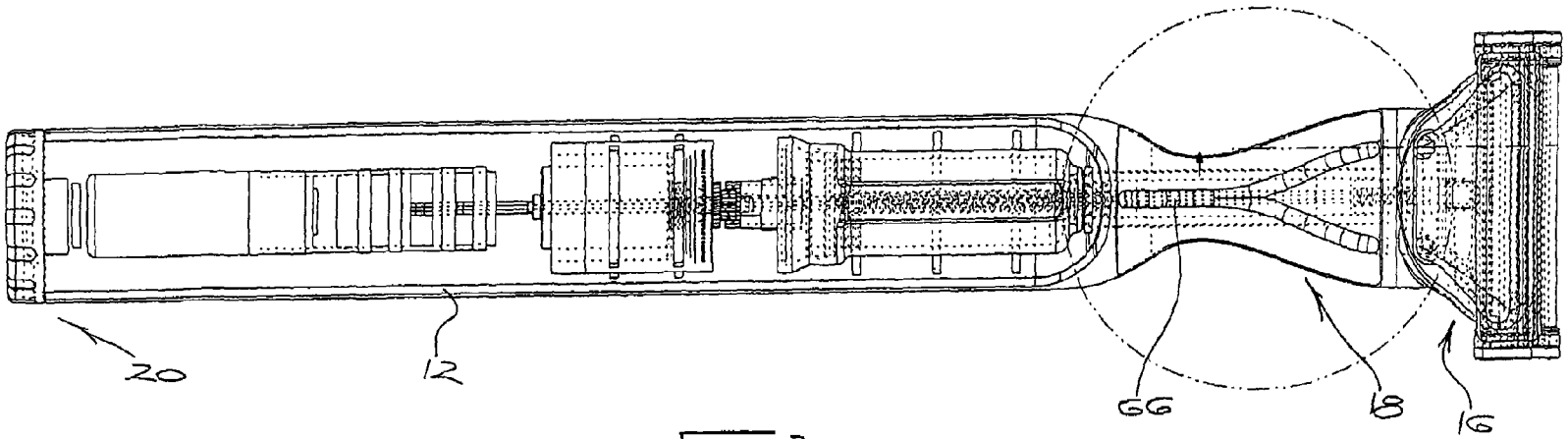
FIG. 2 is a cross sectional view of the razor in a direction which is at a right angle to the view of FIG. 1.
Figure 3:
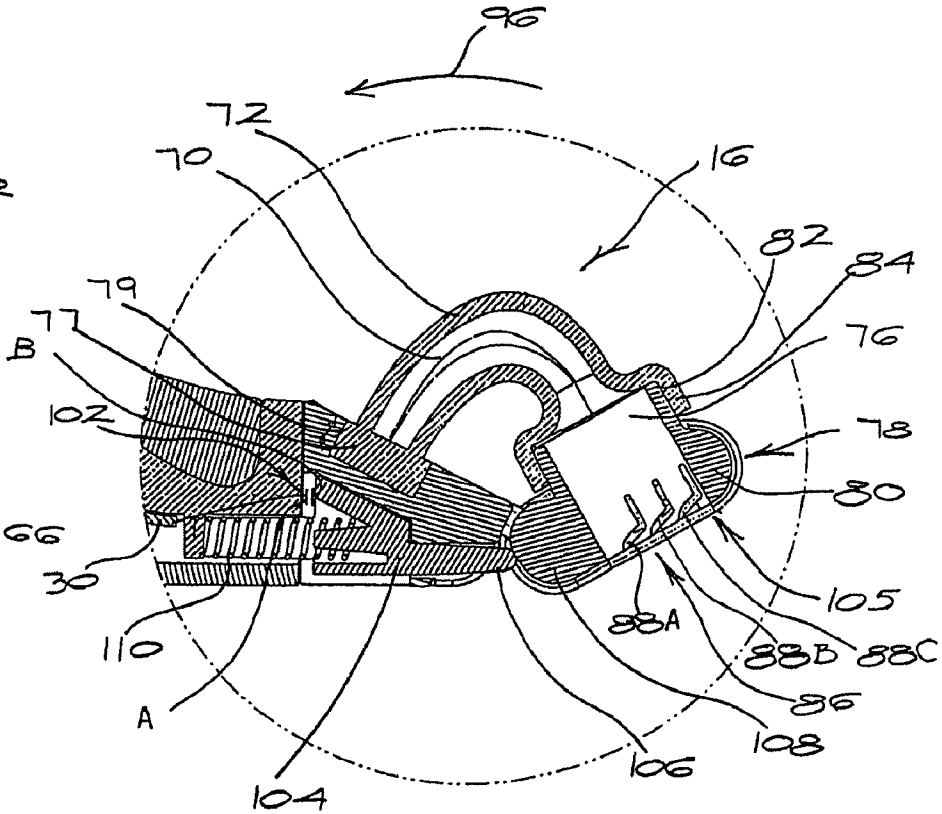
FIG. 3 is an enlarged view of a portion of the razor shown in FIG. 1 which is indicated by means of an arrow marked 3.
Figure 4:
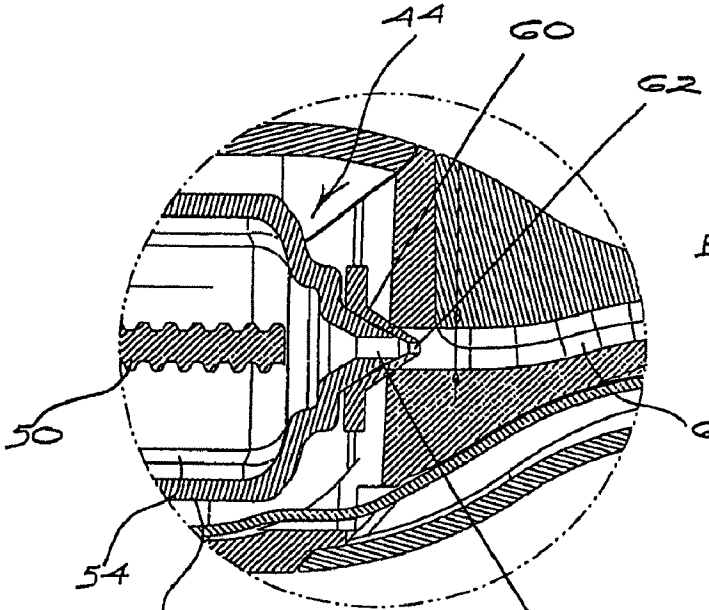
FIG. 4 is an enlarged view of a portion of the razor of FIG. 1 which is indicated by means of an arrow marked 4.
Figure 6:
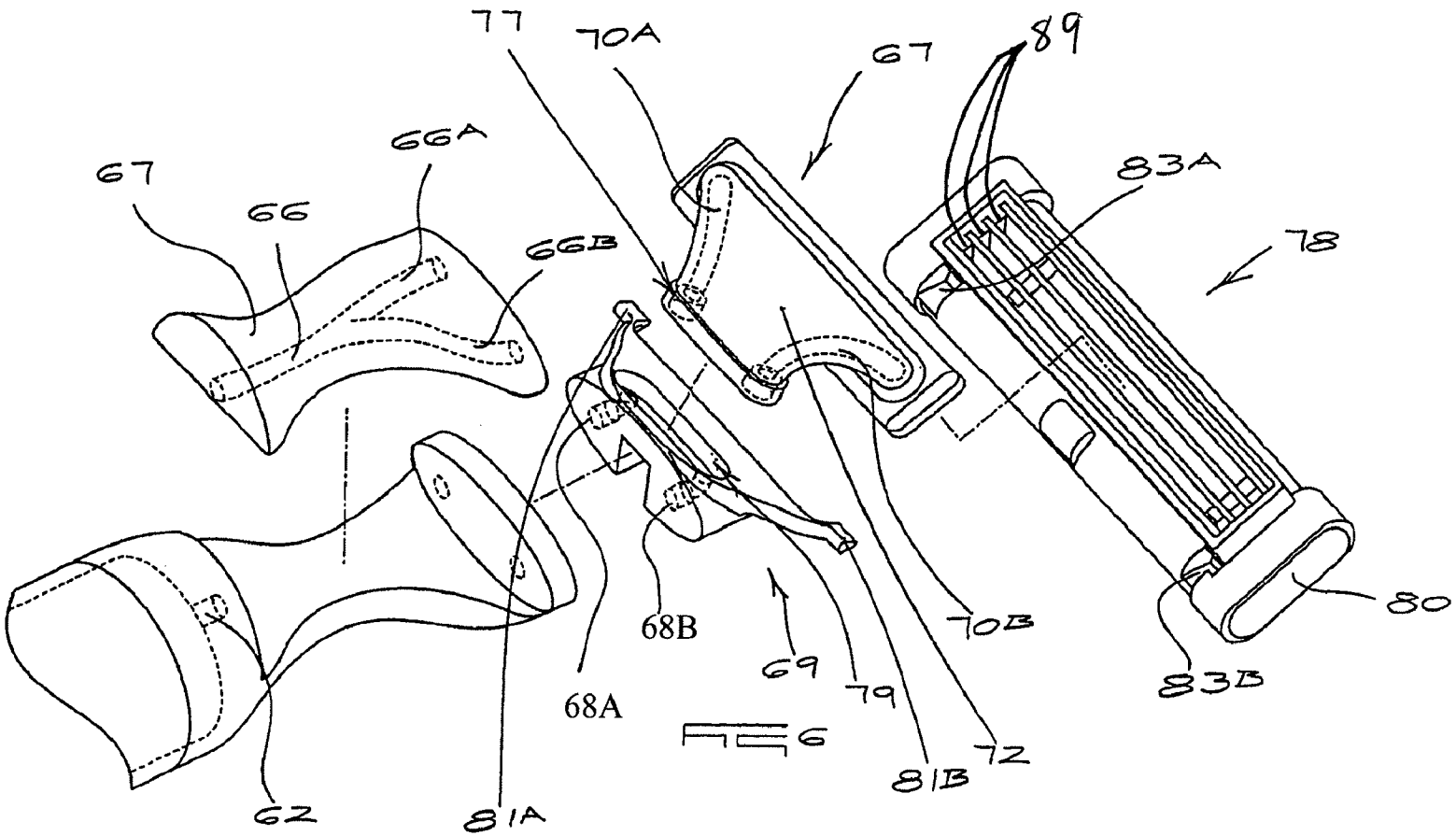
FIG. 6 shows some components of the razor on an enlarged scale and in an exploded configuration.
Figure 7:
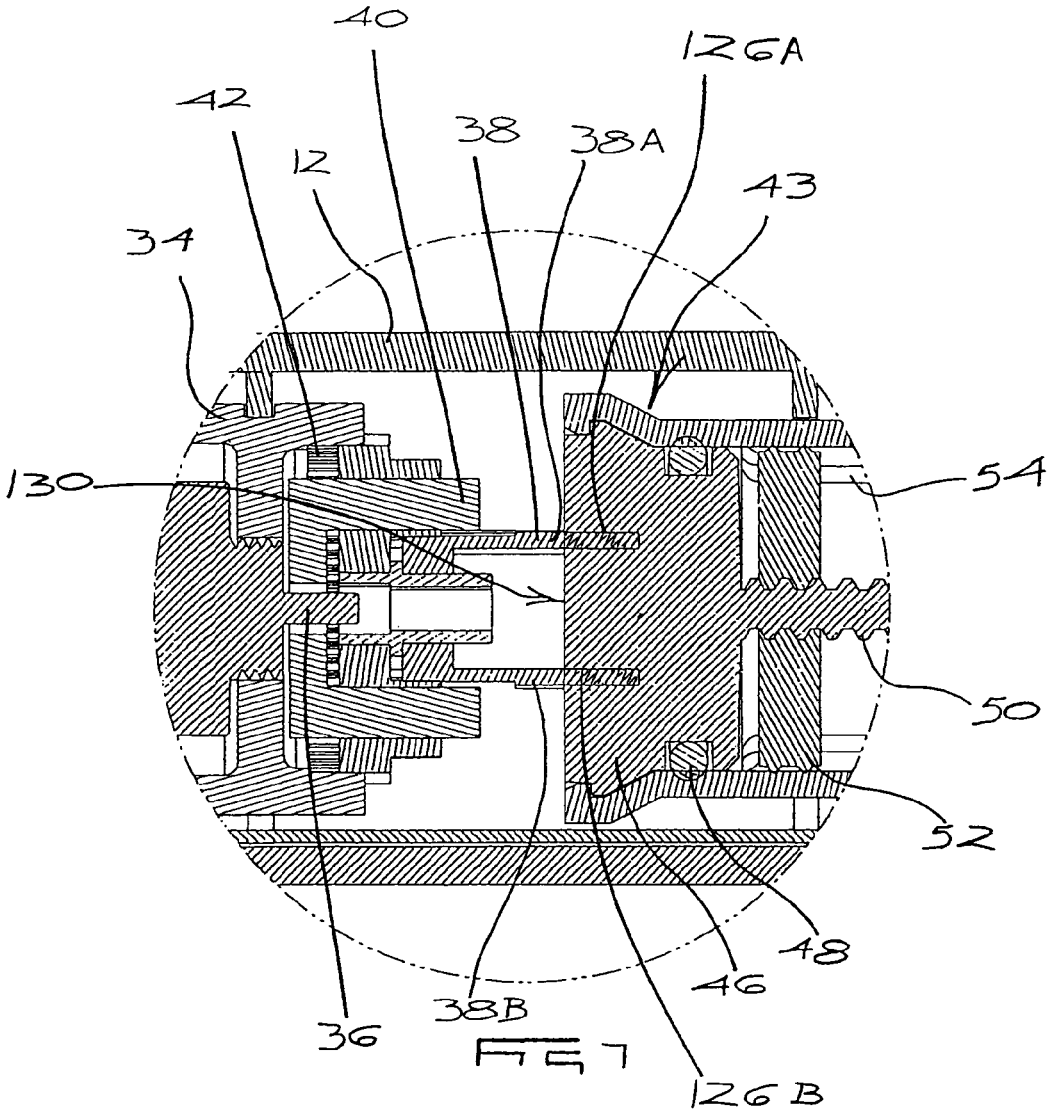
FIG. 7 is a view on an enlarged scale of a portion of the razor shown in FIG. 1 which is indicated by means of an arrow marked 7.

FIGS. 1 and 2 of the accompanying drawings are cross sectional views of a razor 10 according to a first embodiment of the invention taken at a right angle to each other. FIGS. 3, 4 and 7 are views, on an enlarged scale, of portions of the razor shown in FIG. 1 indicated respectively by means of arrows marked 3, 4 and 7. FIG. 6 shows some components in an exploded configuration.

The razor 10 includes a body 12 which is made from a suitable plastics material. An elongate compartment 14 is formed inside the body. A shaving head 16 is detachably engaged with the body.

The body has a leading end 18 and a trailing end 20. Positioned inside the compartment are a battery 22, a controller 24, a stepper motor 26 and a container 28.

The battery 22 is a long life battery of a kind known in the art which, preferably, is rechargeable. The battery can for example be recharged by removing the battery from the compartment, when necessary. Alternatively the battery can be recharged, inside the compartment, when necessary, by connecting the battery to a recharging unit, not shown, using suitable terminals (not shown) provided on the body for the purpose.

The controller 24 is a microprocessor-based device. The function of the controller is to control the application of electrical energy from the battery to the stepper motor. This is done in response to a signal which is input on a line 30 which leads from the shaving head 16 to the controller. This aspect is further described hereinafter.

The controller functions using techniques which are known in the art and which for this reason are not further described in detail herein. Typically the controller, in response to an actuating signal on the line 30, causes the battery to be intermittently connected to the stepper motor 26. This can take place for a limited period or only while the signal is present on the line 30. It is possible to make use of an adjustment dial or switch 32 which is user-actuable and which is used to alter the period or periods for which the battery is connected to the stepper motor by the controller. This is done in accordance with standard electronic control techniques which are known in the art.

The stepper motor 26 is a miniature device and is mounted inside a custom-shaped housing 34. The motor, when energized, rotates through a fixed angle e.g. 5°. The extent of angular rotation is accurately controlled and is predictable due to the inherent construction of the stepper motor. An output shaft 36 from the stepper motor (see FIG. 7) is engaged with a fork-shaped drive device 38 which extends from a small housing 40 to which the drive device is mounted. The housing, in turn, is rotatably mounted on a low friction bearing or insert 42 to the housing 34. Consequently if the motor is energized rotational movement of the shaft 36 causes rotational movement of the drive device 38 and the housing 40.

The container 28 is tubular with an enlarged first end 43 and a tapered second end 44. A plug 46 is rotatably mounted inside the enlarged first end 43 and an interface between the plug and an opposing internal wall of the container is sealed by means of an O-ring seal 48. An elongate threaded shaft 50 extends from the plug axially through the interior of the container. A plunger 52 which fits closely inside the container is threadedly engaged with the shaft. The plunger is constrained from rotating inside the container by means of ribs 54 which are formed on an inner wall surface of the container and which engage with complementary slots in a periphery of the plunger.

A flap valve 60 is closely engaged with an outer surface of the tapered end 44. The flap valve, which is made from a resilient plastics or rubber material, has a small discharge orifice 62 which opposes an exit opening 64 at the tapered end 44. The orifice 62 faces into an exit channel 66 which extends inside a component 67 of the leading end 18, to the shaving head 16. The exit channel 66, at an intermediate location, is forked and two branch lines 66A and 66B of the fork are directed into respective ports 68A and 68B in a component 69 at an extremity of the leading end (see FIG. 6).

Passages 70A and 70B extend inside a curved neck 72 from the ports 68A and 68B of the shaving head to a manifold chamber 76 formed in a cartridge 78 which has a housing 80 which, in outline, is substantially rectangular. A flange 82 of the housing is engaged with a surrounding wall 84 of the neck 72 (see FIG. 5). This is a leak-proof connection.

A volume 86 extends through the housing. Mounted inside the volume are three razor blades designated 88A, 88B and 88C, respectively. The blades are parallel to and are spaced apart from one another and are supported by suitable formations 89 at their respective opposing ends only so that, between each pair of adjacent blades, a respective exit pathway 90A and 90B, is formed. The formations do not extend between adjacent blades. The pathways 90A and 90B are thus unimpeded and form open passages for the flow of the shaving composition. The manifold chamber can be exited via the pathways 90A and 90B. It is also possible to form an exit pathway 92 on a leading side of the blade 88A (referred to herein as the leading blade) and an exit pathway 94 on a trailing side of the blade 88C (referred to herein as the trailing blade).

The number of blades included in the cartridge can be varied according to requirement. Thus, the cartridge can include at least two blades, and up to four, five or even six blades.

Ideally the total cross-sectional area of the exit pathways 90A, 90B, 92 and 94 is smaller than the cross-sectional area of the channel 66. Consequently when the shaving composition flows into the manifold chamber, these volumes become pressurized and effectively act as a plenum. This characteristic helps to promote a smooth, consistent and even flow of the shaving composition from the cartridge.

The cartridge may have a flexible surround which can readily deform, in use of the razor, to ensure that the cutting edges of the blades come into close contact with a surface which is to be shaved. The extent to which the blades protrude is known in the art and is not further described herein. It should be pointed out that the blades are fixed, under factory conditions, to the housing of the cartridge and are supplied in a ready-to-use form. Also the cartridge ensures that the razor blades are presented at an optimum attack angle to a surface which is to be shaved.

Figure 5:
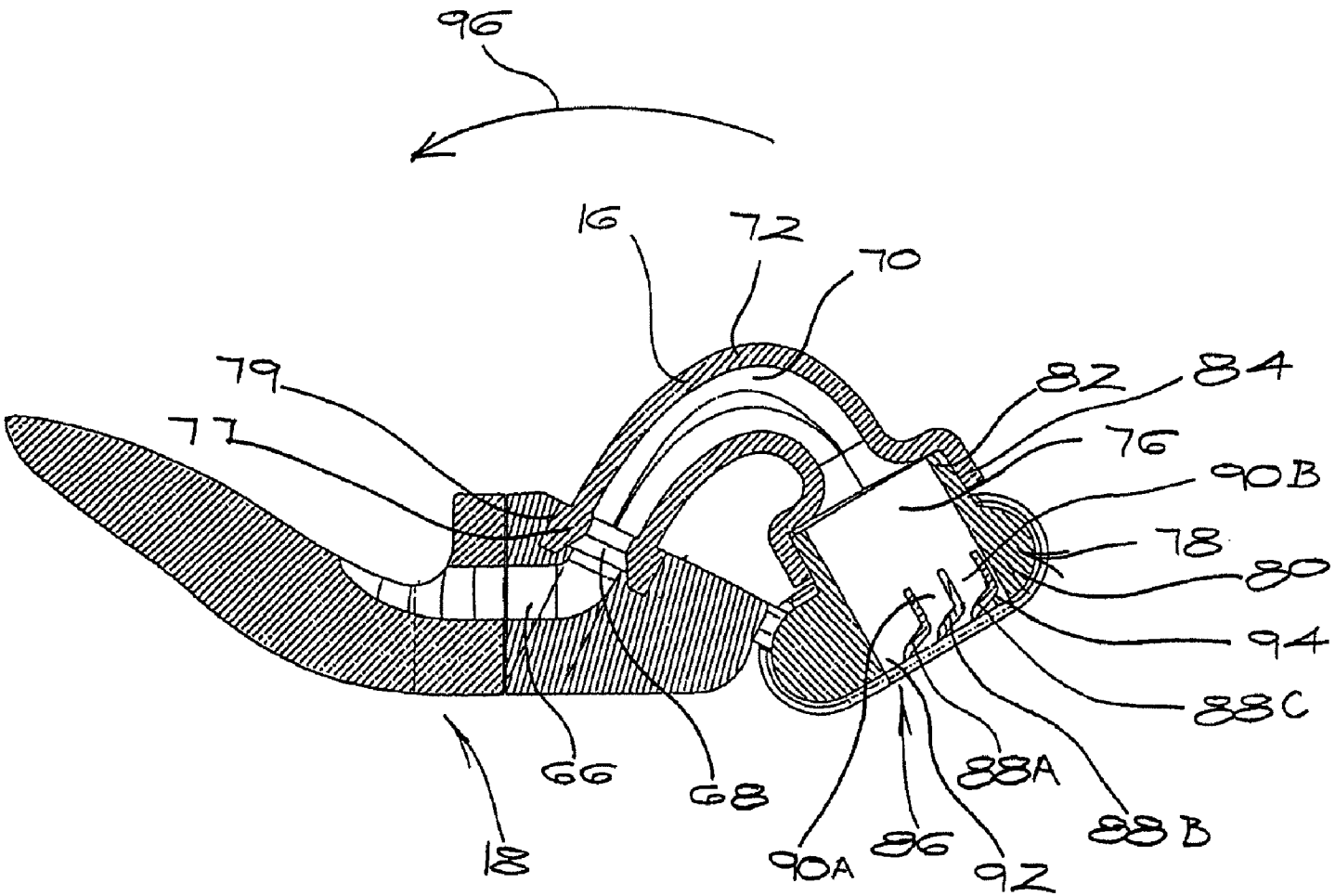
FIG. 5 is similar to FIG. 3 but at a location which is slightly displaced from the location shown in FIG. 3.

The shaving head 16 is detachably engaged with the leading end 18 and is made from a slightly resilient material. The passage 70 is contained in the neck 72 which is made sufficiently slender so that, if slight pressure is applied, the neck can flex slightly towards the body 12 in a direction of an arrow 96 as shown in FIG. 5.

The neck 72 terminates in a clip-like formation 77 which is engageable with a press fit in a complementary recess 79 in the component 69.

The segmented construction of the leading end of the razor is illustrated in the exploded view in FIG. 6. The component 69 has two projections 81A and 81B which extend forwardly and which are engageable with recesses 83A and 83B in the cartridge housing in a way which secures the cartridge to the component but which allows the cartridge to pivot slightly relative to the component.

A small spring-loaded switch 102, which acts as a sensor, is fixed to the body adjacent the shaving head 16, see FIG. 3. The switch includes a switch member 104 with an extension piece 106 which bears against a surface 108 of the shaving head. A spring 110 biases the member 104 towards the shaving head. The arrangement is such that if the shaving head is deflected slightly by pressure applied to an outer surface 105 of the cartridge, in the direction of the arrow 96 that the switch member 104 can then move to the right under the action of the force exerted by the spring 110. This slight degree of movement is translated into operation of the switch 102 which has two opposing contacts A and B, respectively. If the member is moved to the right by the spring then the contacts are opened whereas if the member is moved to the left, against the action of the spring 110 by the natural resilience of the material from which the shaving head is made, then the contacts are connected to each other.

The lead 30 is connected to the contacts and the opening and closing of the contacts, in the manner described, is continuously monitored by the controller 24. If the contacts are closed the controller determines that the razor is inoperative. If the contacts are open the controller interprets this as being caused by a shaving action and an open circuit signal is then sensed at the controller 24.

An interior volume 120 of the container 28 is filled with a shaving composition which is of any appropriate kind known in the art. Typically the shaving composition is a fluent, gel-like material. The flap valve 60 is normally closed due to the inherent resilience of the material from which the valve is made and the orifice 62 is kept at a minimum size.

The body 12 can be opened, when required, by detaching a cap 122 from the trailing end 20 of the body and the components inside the body can then be removed.

The battery, the controller 24 and the stepper motor 26 are generally left inside the compartment. The container 28 on the other hand can be removed from the compartment when required by opening a centrally located screw fitting (not shown) in the body 12. Normally this will be when the contents of the container have been depleted.

The drive device 38 includes two projecting spigots 38A and 38B, respectively. When the container 28 is placed inside the compartment and is correctly aligned, the spigots enter complementary recesses 126A and 126B respectively in a rear face 130 of the plug 46. The body is then reassembled.

When the razor is used, the surface 105 of the shaving head is brought into contact with an area which is to be shaved. The slight pressure, which is thereby exerted by the user, causes flexing of the neck 72 in the direction of the arrow 96. This in turn is detected by the sensing switch arrangement 102 and a signal is applied to the controller 24. In response thereto the controller causes the battery to be connected to the stepper motor 26 which then steps through one or more fixed arcs of movement. The plug 46, which is directly connected to the motor via the drive device, is rotated within the container. The shaft 50 rotates inside the plunger and, as the plunger is constrained from rotating, the rotating movement is translated into linear movement of the plunger inside the housing. The plunger exerts pressure on the shaving composition between the plunger and the tapered end 44 of the container and the increasing pressure causes the flap valve 60 to open. The shaving composition can then pass through the flap valve into the exit channel 66. The shaving composition moves along the forks of the exit channel to the manifold 76 and then passes through the discharge outlets at the razor blades 88A, 88B and 88C to the region which is being shaved. Preferably the composition is discharged ahead of the leading blade and between (at least) two of the trailing blades.

It is possible for the controller to control the operation of the stepper motor in various ways in response to a shaving action. For example the motor can be energized for a fixed period each time the sensing switch arrangement is actuated. A second possibility is for the motor to be energized for the period for which the neck 72 of the shaving head is held in a bent or flexed mode. Another possibility is for the motor to be pulsed for short periods, at regular intervals, for the duration of the time for which a shaving action is being detected. Other possible modes of operation can be programmed into the controller.

The invention thus makes it possible for the shaving composition to be dispensed directly to a shaving zone according to the shaving requirements at the time. The shaving composition is applied to the shaving zone adjacent the razor blades and effective use is therefore made of the shaving composition.

When the contents of the container are depleted, the container is removed and a fresh container takes its place.

Figure 8:
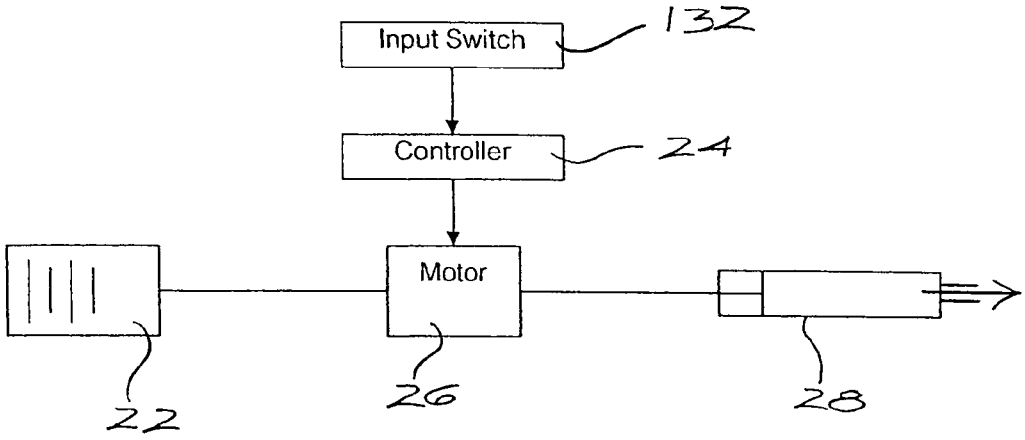
FIG. 8 depicts, schematically, a variation of the invention.

FIG. 8 schematically illustrates a variation of the invention in which the sensing switch arrangement is not used.

A user actuable input device 132 is mounted to an outer surface of the body at a location which is conveniently accessible by a user. The device is preferably an electronic sensor e.g. a proximity sensor or a capacitive type device which, when touched, produces an output signal which is applied to the controller 24, which is microprocessor-based. The period for which the signal is generated is translated by the controller into a control function which regulates the energizing of the motor 26. This can be done in a different ways.

For example the motor can run at a fixed speed while the input signal is generated. Alternatively, the motor speed can be increased gradually while the signal is generated. Another possibility is for the motor to be periodically energized in short bursts while the signal is present. The invention is not limited in this respect.

An advantage of the FIG. 8 embodiment is that the shaving cream can be brought to the shaving head, by user input, before shaving commences, as opposed to being discharged in response to a shaving action. Another benefit is that the construction of the shaving head is simplified.

The switch 32 (FIG. 1) can also function as the input device 132 so that manual and automatic control can be applied to the dispensing of the shaving composition. Another possible variation is to make use of a small gearbox between the motor and the container. This modification is useful particularly if the motor 26 is a high-speed, low-torque device.

The invention claimed is:

1. A razor comprising:

a body;

a shaving head;

at least one formation on the shaving head for engagement with at least one razor blade;

a container for a shaving composition; and an electrically powered actuating mechanism for causing shaving composition from the container to be discharged from the shaving head, wherein the actuating mechanism includes a battery, a controller, a motor, a plunger, and an elongate threaded shaft inside the container, the plunger being threadedly engaged with the shaft and being constrained against rotation within the container, and the motor being energized in a controlled way by the battery and the controller to rotate the shaft and cause the plunger to advance inside the container and expel shaving composition from the container to at least one discharge location at the shaving head.

2. A razor according to claim 1, further including a sensor which is responsive to a shaving action and wherein the controller is responsive to the sensor.

3. A razor according to claim 2, wherein the shaving head is movable to a limited extent relative to the body in response to a shaving action and the sensor is responsive to the shaving head movement.

4. A razor according to claim 1, wherein the at least one razor blade includes a plurality of razor blades, the shaving head is detachably engaged with the body, and the at least one formation includes a plurality of the formations which are engageable with the plurality of razor blades only at respective opposing ends of the blades, and wherein the shaving composition is discharged from the at least one discharge location between two adjacent razor blades.

5. A razor according to claim 1, wherein the container is detachably engaged with the body.

6. A razor according to claim 1, wherein the motor is an electrical stepper motor.

7. A razor according to claim 1, further including a user input device which is used to control operation of the electrically powered actuating mechanism and which is selected from the group consisting of a proximity switch; a capacitive switch; a lever switch; and a rotating switch.

* * * * *